US006962060B2

(12) United States Patent
Petrowski et al.

(10) Patent No.: US 6,962,060 B2
(45) Date of Patent: Nov. 8, 2005

(54) REFRIGERATION COMPRESSION SYSTEM WITH MULTIPLE INLET STREAMS

(75) Inventors: Joseph Michael Petrowski, Pottstown, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 101 days.

(21) Appl. No.: 10/731,998

(22) Filed: Dec. 10, 2003

(65) Prior Publication Data

US 2005/0126219 A1 Jun. 16, 2005

(51) Int. Cl.[7] ..... F25J 1/00; F25J 3/00; F25B 1/10

(52) U.S. Cl. ..... 62/612; 415/116; 62/510

(58) Field of Search ..... 62/612, 611, 614, 62/510; 417/248; 415/116, 199.1, 199.2, 415/199.3, 199.4, 199.5

(56) References Cited

U.S. PATENT DOCUMENTS

| | | | | |
|---|---|---|---|---|
| 3,581,510 A | | 6/1971 | Hughes | |
| 4,251,247 A | * | 2/1981 | Gauberthier et al. | 62/612 |
| 5,365,740 A | | 11/1994 | Kikkawa et al. | |
| 5,611,216 A | | 3/1997 | Low et al. | |
| 5,791,159 A | * | 8/1998 | Aicher et al. | 62/510 |
| 6,334,334 B1 | * | 1/2002 | Stockmann et al. | 62/612 |
| 6,637,238 B2 | * | 10/2003 | Grootjans | 62/613 |
| 6,691,531 B1 | * | 2/2004 | Martinez et al. | 62/612 |
| 6,705,113 B2 | * | 3/2004 | Wei et al. | 62/612 |
| 6,742,357 B1 | * | 6/2004 | Roberts | 62/612 |

FOREIGN PATENT DOCUMENTS

WO WO 01/44734 6/2001

OTHER PUBLICATIONS

Blahovec, James E. et al., "Guidelines for Specifying and Evaluating New and Rerated Multistage Centrifugal Compressors", from *Proceedings of the 27th Turbomachinery Symposium*, Turbomachinery Laboratory, Texas A&M University, College Station, TX, pp. 215-231, Copyright 1998.

* cited by examiner

*Primary Examiner*—William C. Doerrler
(74) *Attorney, Agent, or Firm*—Willard Jones, II

(57) ABSTRACT

Compressor system comprising (a) a first compressor having a first stage and a second stage wherein the first stage of the first compressor is adapted to compress a first gas and the second stage of the first compressor is adapted to compress a combination of a fourth gas and an intermediate compressed gas from the first stage of the first compressor; and (b) a second compressor having a first stage and a second stage wherein the first stage of the second compressor is adapted to compress a second gas and the second stage of the second compressor is adapted to compress a combination of a third gas and an intermediate compressed gas from the first stage of the second compressor. The first gas is at a first pressure, the second gas is at a second pressure higher than the first pressure, the third gas is at a third pressure higher than the second pressure, and the fourth gas is at a fourth pressure higher than the third pressure.

13 Claims, 3 Drawing Sheets

REFRIGERATION COMPRESSION SYSTEM WITH MULTIPLE INLET STREAMS

BACKGROUND OF THE INVENTION

New gas liquefaction and other gas processing plants are being designed for ever-increasing production rates in order to realize the favorable economic benefits associated with larger plants. These larger plants have larger refrigeration duties with higher refrigerant circulation rates, and therefore larger refrigerant compressors are required. As gas processing plants become larger, the maximum achievable production rates may be limited by the maximum available compressor sizes.

When a single refrigerant compressor is used, these increased refrigerant flow rates require larger impellers with higher tip speeds, larger and thicker wall casings, and increased inlet velocities to the impellers. As the sizes of the compressor components are increased, the compressor will reach its fundamental aerodynamic limits, and this will fix the maximum possible compressor capacity. Many refrigeration systems utilize multiple refrigerant streams at different pressures, and these systems generally require compressors having multiple interstage suction inlets. The manufacturing and installation of these large, multistage compressors become significantly more difficult as compressor size increases.

A conventional multistage refrigerant compressor is illustrated schematically in FIG. 1. Refrigeration system 1 represents any type of refrigeration system in which multiple refrigerant streams are vaporized at different pressure levels to provide refrigeration in multiple temperature ranges. In this example, refrigeration system 1 utilizes four refrigerant streams that are vaporized in appropriate heat exchangers at four different pressures to provide refrigeration in four temperature ranges. Four vaporized refrigerant streams in lines 3, 5, 7, and 9, each at a different pressure, are withdrawn from system 1 and are introduced into the stages of multistage compressor 11 at the appropriate locations depending on the pressure of each stream.

The lowest pressure vaporized refrigerant in line 3 is introduced into the inlet of first stage 13, which may be designated as low pressure stage A. The low-intermediate pressure refrigerant stream in line 5 is introduced into second stage 15 of compressor 11, which may be designated as low-intermediate pressure stage B. The high-intermediate pressure refrigerant stream in line 7 is introduced into third stage 17 of compressor 11, which may be designated as high-intermediate pressure stage C. The high pressure refrigerant stream in line 9 is introduced into fourth stage 19 of compressor 11, which may be designated as high-pressure stage D. Each stage of the compressor may comprise one or more impellers and will compress an increasing mass flow of gas. Final compressed refrigerant gas returns via line 21 to refrigeration system 1.

The mass flow through low pressure stage A (first stage 13) is the mass flow entering in line 3; the mass flow in low-intermediate pressure stage B (second stage 15) is the sum of the mass flows entering in lines 3 and 5; the mass flow in high-intermediate pressure stage C (third stage 17) is the sum of the mass flows entering in lines 3, 5, and 7; and the mass flow in high pressure stage D (third stage 19) is the sum of the mass flows entering in lines 3, 5, 7, and 9.

When using single multiple-stage compressor 11 at a fixed driver speed, the total flow capability of the refrigeration system is limited by restrictions in the aerodynamic shape factors and flow factors which are used to design the compressor impellers. A speed reduction gear or a slower speed driver may eliminate these constraints in some cases. However, a speed reduction gear will add capital cost and result in mechanical power losses. Also, a speed reduction gear may complicate the mechanical torsional constraints of the compressor system and compromise the mechanical design of the system. The slower speed compressor stage in such a system will require larger casing sizes and larger impellers, which will add significantly to both the capital and installation costs. Thus the maximum size of single multiple-stage compressor 11 may be limited by any of these design factors.

Several alternative methods have been proposed in the art to compress large refrigerant flows in a multi-level refrigeration system. One solution is to use two identical half-size parallel compressors having a common inlet suction pressure source, common intermediate suction pressure sources, and a common outlet discharge pressure. The piping systems around the two parallel compressors must be meticulously designed and balanced so that both machines operate with the same flows through all stages of the compressors. Any flow imbalance between the two compressors will cause one of the units to reach surge (flow reversal) prematurely. Slight differences in manufacturing tolerances between the two machines, such as in the casings and impellers, will also contribute to flow imbalance.

Another alternative method to compress large refrigerant flows in a multi-level refrigeration system is disclosed in International Publication WO 01/44734 A2 and is illustrated in FIG. 2. In this alternative, the lowest pressure vaporized refrigerant in line 3 is introduced into the inlet of first stage 23, which may be designated as low pressure stage A, of first compressor 25. The high-intermediate pressure refrigerant stream in line 7 is introduced into second stage 27, which may be designated as high-intermediate pressure stage C, of first compressor 25. The low-intermediate pressure refrigerant stream in line 5 is introduced into first stage 29, which also is designated as low-intermediate pressure stage B, of second compressor 31. The high pressure refrigerant stream in line 9 is introduced into second stage 33, which may be designated as high pressure stage D, of compressor 11. Each stage of compressors 25 and 31 may comprise one or more impellers and will compress an increasing mass flow of gas. Final compressed refrigerant gas streams in lines 35 and 37 are combined and returned via line 39 to refrigeration system 1.

The mass flow through low pressure stage A (first stage 23) is the mass flow entering in line 3; the mass flow in high-intermediate pressure stage C (second stage 27) is the sum of the mass flows entering in lines 3 and 7; the mass flow in low-intermediate pressure stage B (first stage 29) is the mass flow entering in line 5, and the mass flow in high pressure stage D (third stage 33) is the sum of the mass flows entering in lines 5 and 9. This split compressor arrangement provides a method to eliminate the size and inlet velocity problems of single large compressor 11 (FIG. 1) without incurring the balancing problems of two identical half-size compressors discussed above.

Because gas liquefaction and other gas processing plants are being designed for ever-increasing production rates in order to realize the favorable economic benefits associated with larger plants, alternative methods are needed to eliminate the size and inlet velocity problems of single large compressors. Embodiments of the present invention, as described below and defined by the claims that follow, provide an alternative method for the design of refrigerant compressors for large gas liquefaction and processing plants.

BRIEF SUMMARY OF THE INVENTION

An embodiment of the invention includes a compressor system comprising (a) a first compressor having a first stage and a second stage wherein the first stage of the first compressor is adapted to compress a first gas and the second stage of the first compressor is adapted to compress a combination of a fourth gas and an intermediate compressed gas from the first stage of the first compressor; and (b) a second compressor having a first stage and a second stage wherein the first stage of the second compressor is adapted to compress a second gas and the second stage of the second compressor is adapted to compress a combination of a third gas and an intermediate compressed gas from the first stage of the second compressor. The first gas is at a first pressure, the second gas is at a second pressure higher than the first pressure, the third gas is at a third pressure higher than the second pressure, and the fourth gas is at a fourth pressure higher than the third pressure.

The system may further comprise piping means to combine the discharge from the second stage of the first compressor and the discharge from the second stage of the second compressor to provide a combined compressed gas.

Another embodiment of the invention relates to a method for gas compression comprising (a) compressing a first gas in a first stage of a first compressor and compressing in a second stage of the first compressor a combination of a fourth gas and an intermediate compressed gas from the first stage of the first compressor, and withdrawing a first compressed gas stream from the second stage of the first compressor; (b) compressing a second gas in a first stage of a second compressor and compressing in a second stage of the second compressor a combination of a third gas and an intermediate compressed gas from the first stage of the second compressor, and withdrawing a second compressed gas stream from the second stage of the second compressor; and (c) combining the first compressed gas stream and the second compressed gas stream to provide a final compressed gas stream. The first gas is at a first pressure, the second gas is at a second pressure higher than the first pressure, the third gas is at a third pressure higher than the second pressure, the fourth gas is at a fourth pressure higher than the third pressure, and the final compressed gas stream is at a final pressure higher than the fourth pressure.

Any of the first, second, third, and fourth gases may be a refrigerant gas provided from a refrigeration system and the final compressed gas stream may be a compressed refrigerant gas provided to the refrigeration system.

An alternative embodiment of the invention includes a refrigeration system for providing refrigeration at multiple temperature levels comprising (a) a compressor system for providing a compressed refrigerant gas, wherein the compressor system includes
  (1) a first compressor having a first stage and a second stage wherein the first stage of the first compressor is adapted to compress a first refrigerant gas and the second stage of the first compressor is adapted to compress a combination of a fourth refrigerant gas and an intermediate compressed refrigerant gas from the first stage of the first compressor; and
  (2) a second compressor having a first stage and a second stage wherein the first stage of the second compressor is adapted to compress a second refrigerant gas and the second stage of the second compressor is adapted to compress a combination of a third refrigerant gas and an intermediate compressed refrigerant gas from the first stage of the second compressor; and
  (3) piping means to combine the discharge from the second stage of the first compressor and the discharge from the second stage of the second compressor to provide the compressed refrigerant gas;

wherein the first refrigerant gas is at a first pressure, the second refrigerant gas is at a second pressure higher than the first pressure, the third refrigerant gas is at a third pressure higher than the second pressure, and the fourth refrigerant gas is at a fourth pressure higher than the third pressure;

(b) a compressor aftercooler to cool and condense the compressed refrigerant gas, thereby providing a condensed refrigerant stream; and (c) a refrigeration apparatus adapted to provide refrigeration in four temperature ranges, wherein the refrigerant apparatus comprises
  (1) first pressure reduction means to reduce the pressure of the condensed refrigerant stream to the fourth pressure, thereby providing a reduced-pressure refrigerant liquid at the fourth pressure;
  (2) piping means to divide the reduced-pressure refrigerant liquid at the fourth pressure into a first refrigerant portion and a second refrigerant portion at the fourth pressure;
  (3) heat exchange means to vaporize the first refrigerant portion of (2) at the fourth pressure, thereby providing refrigeration in a first temperature range and providing the fourth refrigerant gas;
  (4) second pressure reduction means to reduce the pressure of the second refrigerant portion of (2) from the fourth pressure to the third pressure, thereby providing a reduced-pressure refrigerant at the third pressure;
  (5) piping means to divide the reduced-pressure refrigerant liquid at the third pressure into a first refrigerant portion and a second refrigerant portion at the third pressure;
  (6) heat exchange means to vaporize the first refrigerant portion of (5) at the third pressure, thereby providing refrigeration in a second temperature range and providing the third refrigerant gas;
  (7) third pressure reduction means to reduce the pressure of the second refrigerant portion of (5) from the third pressure to the second pressure, thereby providing a reduced-pressure refrigerant at the second pressure;
  (8) piping means to divide the reduced-pressure refrigerant liquid at the second pressure into a first refrigerant portion and a second refrigerant portion at the second pressure;
  (9) heat exchange means to vaporize the first refrigerant portion of (8) at the second pressure, thereby providing refrigeration in a third temperature range and providing the second refrigerant gas;
  (10) fourth pressure reduction means to reduce the pressure of the second refrigerant portion of (8) from the second pressure to the first pressure, thereby providing a reduced-pressure refrigerant at the first pressure; and
  (11) heat exchange means to vaporize the reduced-pressure refrigerant at the first pressure, thereby providing refrigeration in a fourth temperature range and providing the first refrigerant gas.

The refrigeration apparatus may be adapted to cool another compressed refrigerant gas. The refrigerant apparatus may be adapted to precool natural gas prior to liquefaction.

Another alternative embodiment of the invention includes a refrigeration process comprising (a) providing a compressor system including (1) a first compressor having a first stage and a second stage wherein the first stage of the first compressor is adapted to compress a first refrigerant gas and the second stage of the first compressor is adapted to compress a combination of a fourth refrigerant gas and an intermediate compressed refrigerant gas from the first stage of the first compressor; and (2) a second compressor having a first stage and a second stage wherein the first stage of the second compressor is adapted to compress a second refrigerant gas and the second stage of the second compressor is adapted to compress a combination of a third refrigerant gas and an intermediate compressed refrigerant gas from the first stage of the second compressor; and (3) piping means to combine the discharge from the second stage of the first compressor and the discharge from the second stage of the second compressor to provide a compressed refrigerant gas;

wherein the first refrigerant gas is at a first pressure, the second refrigerant gas is at a second pressure higher than the first pressure, the third refrigerant gas is at a third pressure higher than the second pressure, and the fourth refrigerant gas is at a fourth pressure higher than the third pressure;

(b) compressing a refrigerant gas in the compressor system of (a) to provide a compressed refrigerant gas;

(c) cooling and condensing the compressed refrigerant gas, thereby providing a condensed refrigerant stream; and (d) providing refrigeration in four temperature ranges by (1) reducing the pressure of the condensed refrigerant stream to the fourth pressure, thereby providing a reduced-pressure refrigerant liquid at the fourth pressure;

(2) dividing the reduced-pressure refrigerant liquid at the fourth pressure into a first refrigerant portion and a second refrigerant portion at the fourth pressure;

(3) vaporizing the first refrigerant portion of (2) at the fourth pressure, thereby providing refrigeration in a first temperature range and providing the fourth refrigerant gas;

(4) reducing the pressure of the second refrigerant portion of (2) from the fourth pressure to the third pressure, thereby providing a reduced-pressure refrigerant at the third pressure;

(5) dividing the reduced-pressure refrigerant liquid at the third pressure into a first refrigerant portion and a second refrigerant portion at the third pressure;

(6) vaporizing the first refrigerant portion of (5) at the third pressure, thereby providing refrigeration in a second temperature range and providing the third refrigerant gas;

(7) reducing the pressure of the second refrigerant portion of (5) from the third pressure to the second pressure, thereby providing a reduced-pressure refrigerant at the second pressure;

(8) dividing the reduced-pressure refrigerant liquid at the second pressure into a first refrigerant portion and a second refrigerant portion at the second pressure;

(9) vaporizing the first refrigerant portion of (8) at the second pressure, thereby providing refrigeration in a third temperature range and providing the second refrigerant gas;

(10) reducing the pressure of the second refrigerant portion of (8) from the second pressure to the first pressure, thereby providing a reduced-pressure refrigerant at the first pressure; and

(11) vaporizing the reduced-pressure refrigerant at the first pressure, thereby providing refrigeration in a fourth temperature range and providing the first refrigerant gas.

The process may further comprise cooling an additional compressed refrigerant gas by the refrigeration provided in at least one of the first, second, third, and fourth temperature ranges. The additional compressed refrigerant gas may be a mixed refrigerant gas containing two or more components selected from the group consisting of nitrogen and hydrocarbons having from one to five carbon atoms.

The process may further comprise precooling natural gas prior to liquefaction by the refrigeration provided in at least one of the first, second, third, and fourth temperature ranges. The compressed refrigerant gas may be a single component selected from hydrocarbons having from two to four carbon atoms. Alternatively, the compressed refrigerant gas may comprise two or more components selected from the group consisting of nitrogen and hydrocarbons having from one to five carbon atoms.

DETAILED DESCRIPTION OF THE INVENTION

An embodiment of the invention includes a compressor system having a first compressor with a first stage and a second stage, wherein the first stage of the first compressor is adapted to compress a first refrigerant gas and the second stage of the first compressor is adapted to compress a combination of a fourth refrigerant gas and an intermediate compressed refrigerant gas from the first stage of the first compressor. The compressor system also has a second compressor with a first stage and a second stage, wherein the first stage of the second compressor is adapted to compress a second refrigerant gas and the second stage of the second compressor is adapted to compress a combination of a third refrigerant gas and an intermediate compressed refrigerant gas from the first stage of the second compressor.

The first refrigerant gas is at a first pressure, the second refrigerant gas is at a second pressure higher than the first pressure, the third refrigerant gas is at a third pressure higher than the second pressure, and the fourth refrigerant gas is at a fourth pressure higher than the third pressure.

The term "stage" as used herein means a compressor or compressor segment having one or more impellers wherein the mass flow of the fluid being compressed in the stage is constant through the stage.

Figure 3:
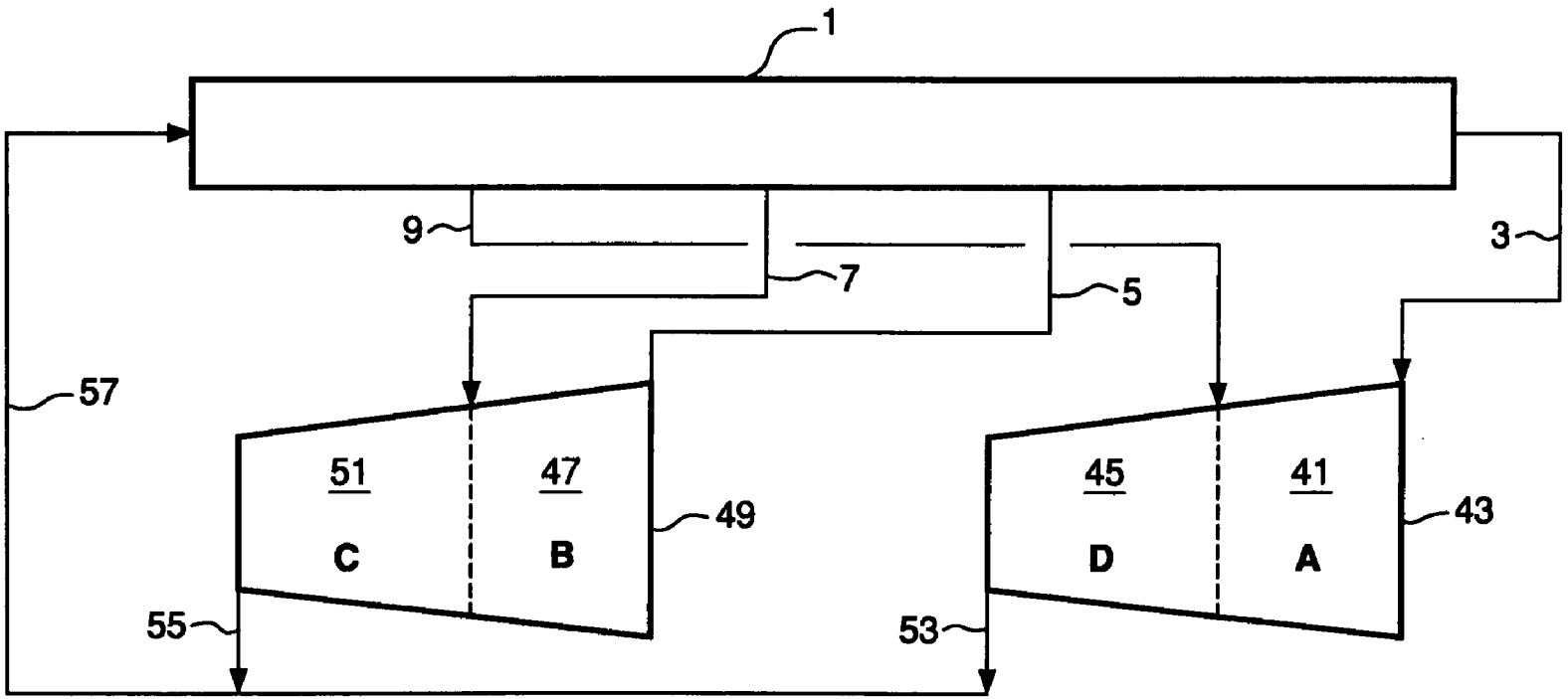
FIG. 3 is a schematic flow diagram of a multi-level refrigerant compressor system according to an embodiment of the present invention.

This embodiment of the invention is illustrated schematically in FIG. 3. In this embodiment, the lowest pressure vaporized refrigerant in line 3 is introduced into the inlet of first stage 41, which may be designated as low pressure stage A, of first compressor 43. The high pressure refrigerant stream in line 9 is introduced into second stage 45, which may be designated as high pressure stage D, of first compressor 43. The low-intermediate pressure refrigerant stream in line 5 is introduced into first stage 47, which may be designated as low-intermediate pressure stage B, of second compressor 49. The high-intermediate pressure refrigerant stream in line 7 is introduced into second stage 51, which may be designated as high-intermediate pressure stage C, of second compressor 49. Each stage of compressors 43 and 49 may comprise one or more impellers and will compress an increasing mass flow of gas. Final compressed refrigerant gas streams in lines 53 and 55 are combined and returned via line 57 to refrigeration system 1.

The mass flow through low pressure stage A (first stage 41) is the mass flow entering in line 3; the mass flow in high pressure stage D (second stage 45) is the sum of the mass flows entering in lines 3 and 9; the mass flow in low-intermediate pressure stage B (first stage 47) is the mass flow entering in line 5; and the mass flow in high-intermediate pressure stage C (third stage 51) is the sum of the mass flows entering in lines 5 and 7. This split compressor arrangement provides an alternative method to eliminate the size and inlet velocity problems of single large compressor 11 (FIG. 1) without incurring the balancing problems of two identical half-size compressors discussed above.

The embodiment of the invention described above is compared to the prior art methods of FIGS. 1 and 2 in Table 1 below. The Table shows the mass flow rates through each compressor stage in terms of representative mass flow rates $F_3$, $F_5$, $F_7$, and $F_9$ of refrigerant in lines 3, 5, 7, and 9, respectively.

TABLE 1

Figure 1:
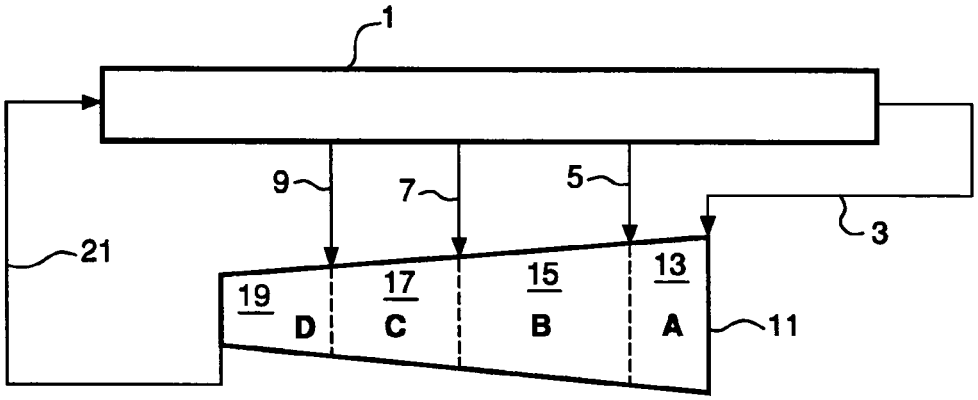
FIG. 1 (Prior Art)
FIG. 1 is a schematic flow diagram of a multi-level refrigerant compressor system according to the prior art.
Figure 2:
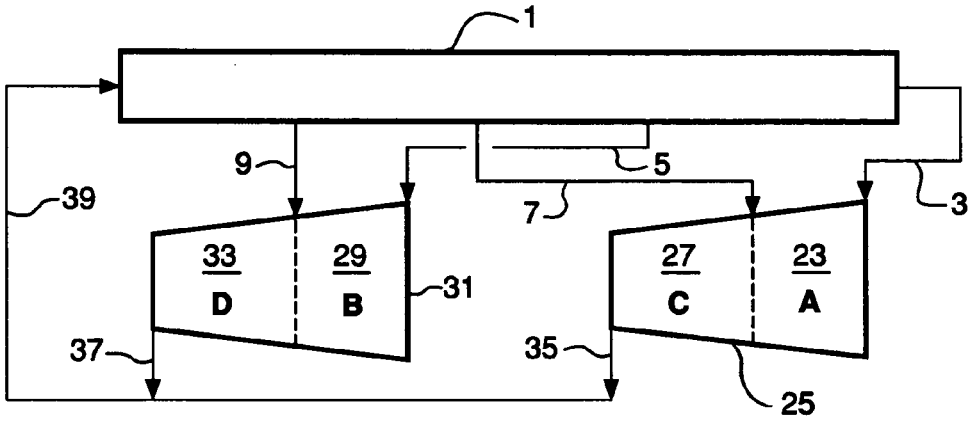
FIG. 2 (Prior Art)
FIG. 2 is a schematic flow diagram of another multi-level refrigerant compressor system according to the prior art.

| | Comparison of FIG. 3 Embodiment With FIGS. 1 and 2 | | |
|---|---|---|---|
| Compressor | Representative Mass Flow Rates | | |
| Stage | FIG. 1 (Prior Art) | FIG. 2 (Prior Art) | FIG. 3 |
| Low Pressure (A) | $F_3$ | $F_3$ | $F_3$ |
| Low-Intermediate Pressure (B) | $F_3 + F_5$ | $F_5$ | $F_5$ |
| High-Intermediate Pressure (C) | $F_3 + F_5 + F_7$ | $F_3 + F_7$ | $F_5 + F_7$ |
| High Pressure (D) | $F_3 + F_5 + F_7 + F_9$ | $F_5 + F_9$ | $F_3 + F_9$ |

The turndown range, efficiency and flow capacity of a compressor are determined largely by the inlet flow coefficient and the relative inlet Mach number of each individual impeller. The relative inlet Mach number is a direct function of the molecular weight of the gas being compressed and the geometry of the impeller at its inlet.

The impeller tip speed Mach number or equivalent tip speed also is an important measure of impeller turndown range and flow capacity and is used in the initial sizing of compressors when the inlet geometry is unknown. The tip speed Mach number is calculated at the tip diameter of the impeller. The inlet flow coefficient and impeller tip speed are functions of the inlet volumetric flow rate, the rotational speed of the impeller and the impeller diameter. A high tip speed reduces the turndown range of the impeller. A high flow coefficient and high tip speed also limit the flow capacity of the impeller. This is described in a paper by J. F. Blahovec et al, presented at the Proceedings of the $27^{th}$ Turbomachinery Symposium, College Station, Texas, 1998.

An illustration of an application of the compression system described above is given in FIG. 4 for the use of propane refrigerant to cool a process stream. In this application, compressed refrigerant gas in line 57 at 150 to 250 psia is cooled and condensed in heat exchanger 59 to provide a condensed refrigerant stream in line 61 at 50 to 120° F. A portion of the condensed refrigerant is reduced in pressure across throttling valve 63 to a fourth pressure of 75 to 125 psia and introduced into heat exchanger 65, wherein the refrigerant vaporizes and provides refrigeration to cool process stream 67. Vaporized refrigerant returns via line 9 to provide a fourth refrigerant gas via line 9 to low-intermediate compressor stage 45.

Unvaporized liquid refrigerant from heat exchanger 65 is withdrawn via line 69 and reduced in pressure across throttling valve 71 to a third pressure of 40 to 70 psia and introduced into heat exchanger 73, wherein the refrigerant vaporizes and provides refrigeration to cool process stream 75 from heat exchanger 65. Vaporized refrigerant is withdrawn from the heat exchanger to return a third refrigerant gas via line 7 to high pressure compressor stage 51.

Unvaporized liquid refrigerant is withdrawn via line 77, reduced in pressure across throttling valve 79 to a second pressure of 20 to 30 psia, and introduced into heat exchanger 81, wherein the refrigerant vaporizes and provides refrigeration to cool process stream 83 from heat exchanger 73. Vaporized refrigerant is withdrawn from the heat exchanger to return a second refrigerant gas via line 5 to high-intermediate pressure compressor stage 47.

Unvaporized liquid refrigerant is withdrawn via line 85, reduced in pressure across throttling valve 87 to a first pressure of 14 to 21 psia, and introduced into heat exchanger 89, wherein the refrigerant vaporizes and provides refrigeration to cool process stream 91 from heat exchanger 97. Vaporized refrigerant returns via line 3 to provide a first refrigerant gas to low pressure compressor stage 41. A final cooled process stream is withdrawn via line 93.

The first, second, third, and fourth refrigerant gas streams in lines 3, 5, 7, and 9 are compressed in compressor stages 41, 47, 51, and 45, respectively, to provide compressed refrigerant gas in lines 53, 55, and 57 as described earlier.

Process stream 67 may be, for example, a natural gas stream that is precooled prior to further cooling and liquefaction by a refrigeration system utilizing a mixed liquid refrigerant or by a hybrid refrigeration system comprising a refrigeration system utilizing a mixed liquid refrigerant at intermediate temperatures and a gas expander refrigeration system at lower temperatures down to the liquefaction temperature.

Additional refrigeration optionally may be provided to cool another process stream 95 wherein a second portion of the condensed refrigerant in line 61 is reduced in pressure across throttling valve 97 to the fourth pressure of 75 to 125 psia and introduced into heat exchanger 99, wherein the refrigerant vaporizes and provides refrigeration to cool process stream 95. Vaporized refrigerant returns via lines 101 and 9 to low-intermediate compressor stage 45.

Unvaporized liquid refrigerant from heat exchanger 99 is withdrawn via line 103, reduced in pressure across throttling valve 105 to the third pressure of 40 to 70 psia, and introduced into heat exchanger 107, wherein the refrigerant vaporizes and provides refrigeration to cool process stream 109 from heat exchanger 99. Vaporized refrigerant is withdrawn from the heat exchanger and returned via lines 111 and 7 to high pressure compressor stage 51.

Unvaporized liquid refrigerant is withdrawn from heat exchanger 107 via line 113, reduced in pressure across throttling valve 115 to the second pressure of 20 to 30 psia, and introduced into heat exchanger 117, wherein the refrigerant vaporizes and provides refrigeration to cool process stream 119 from heat exchanger 109. Vaporized refrigerant is withdrawn from the heat exchanger to return a second refrigerant gas via lines 121 and 5 to high-intermediate pressure compressor stage 47.

Unvaporized liquid refrigerant is withdrawn via line 123, reduced in pressure across throttling valve 125 to the first pressure of 14 to 21 psia, and introduced into heat exchanger 127, wherein the refrigerant vaporizes and provides refrigeration to cool process stream 129 from heat exchanger 117. Vaporized refrigerant returns via lines 131 and 3 to low pressure compressor stage 41. A final cooled process stream is withdrawn via line 133.

Process stream 95 may be, for example, a compressed mixed refrigerant stream in a refrigeration system (not shown) that is used to further cool and liquefy a precooled natural gas stream provided via line 93. Alternatively, process stream 95 may be a compressed mixed refrigerant stream in a hybrid refrigeration system (not shown) comprising a refrigeration system utilizing a mixed liquid refrigerant at intermediate temperatures and a gas expander refrigeration system at lower temperatures down to the liquefaction temperature.

While the embodiment of the invention is illustrated above for the compression of four refrigerant gas streams provided at different pressures from a refrigeration system, the compression system as described may be used to compress four gas streams containing any type of gas used for any purpose. For example, the compression system may be used to compress a mixed refrigerant used in a vapor recompression type of refrigeration system wherein the condensed mixed refrigerant is vaporized at four different pressures.

The following Examples illustrate embodiments of the present invention but do not limit the invention to any of the specific details described therein.

EXAMPLE 1

Figure 4:
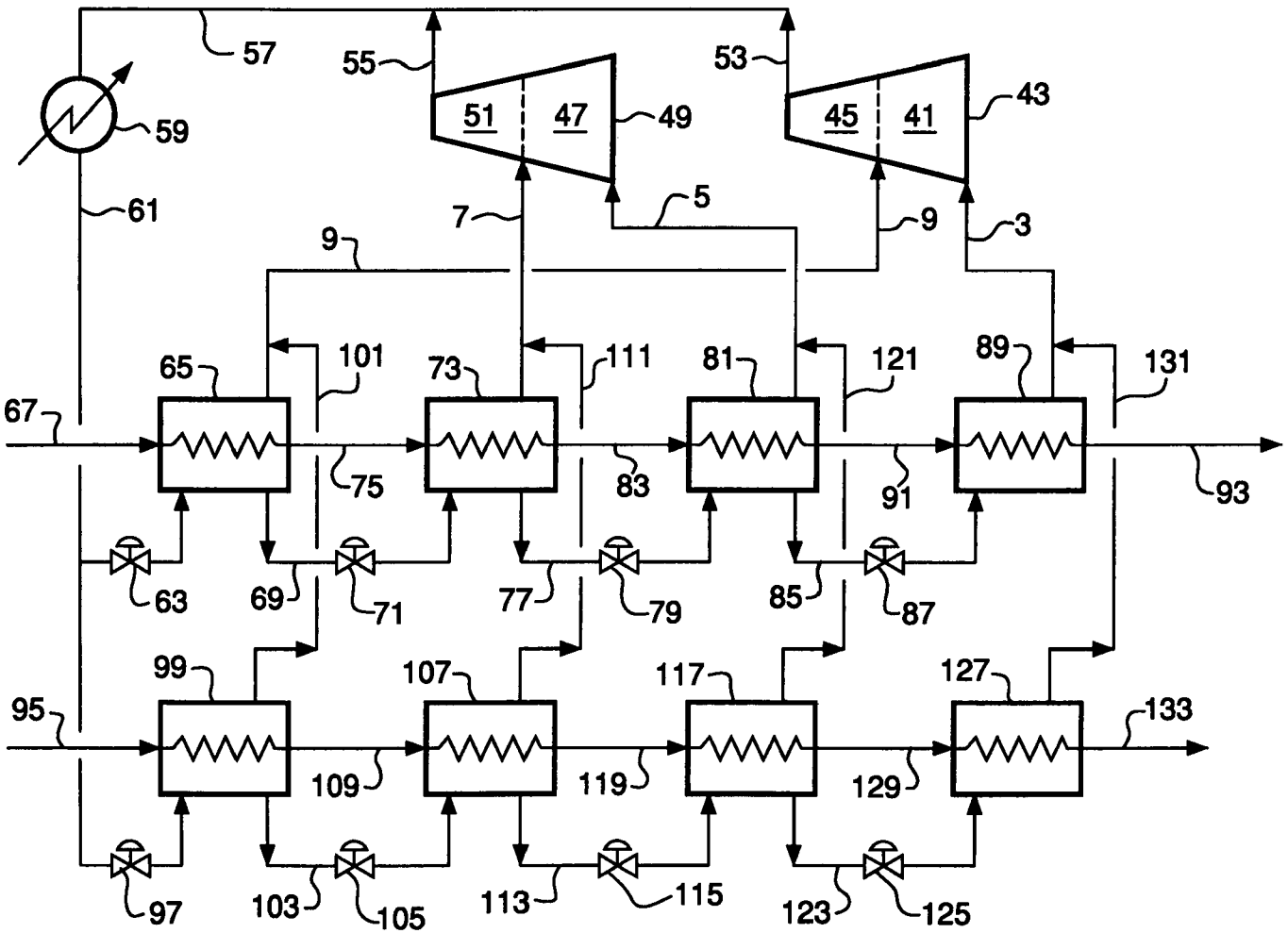
FIG. 4 is an exemplary application of the compressor system of FIG. 3 in a refrigeration system for cooling two process streams.

Natural gas is liquefied at a production rate of 4 million ton/yr with the co-production of 1 million ton/yr of liquefied petroleum gas (LPG) using a propane precooled mixed refrigerant liquefaction process. The propane refrigeration system of FIG. 4 is used to precool the feed gas prior to final cooling and liquefaction, to cool the compressed mixed refrigerant, and also to provide auxiliary refrigeration to the liquefaction plant. The vaporized propane refrigerant flow rates and conditions are as follows: 16,909 lbmoles per hour at −36° F. and 16 psia at the inlet to low pressure stage 41; 32,042 lbmoles per hour at −13° F. and 28 psia at the inlet to low-intermediate pressure stage 45; 33,480 lbmoles per hour at +20° F. and 54 psia at the inlet to high-intermediate pressure stage 51; and 32,772 lbmoles per hour at +60° F. and 106 psia at the inlet to high pressure stage 45. The resulting total compressed propane refrigerant flow delivered to the refrigeration circuits via line 61 after cooling in aftercooler 59 is 115,203 lbmoles per hour at +112° F. and 208 psia.

In this Example, compressor stage 41 has three impellers, compressor stage 47 has one impeller, compressor stage 51 has two impellers, and compressor stage 45 has two impellers. The process parameters and calculated power requirements are summarized in Table 2. The power requirements are based on average individual impeller efficiencies for large compressors which are currently available from compressor manufacturers.

TABLE 2

Compressor Parameters for Example 1 (Refer to FIG. 4)

| | | Stage 41 | Stage 47 | Stage 51 | Stage 45 |
|---|---|---|---|---|---|
| Suction Volume, $ft^3$/min | | 76,950 | 86,680 | 96,615 | 38,900 |
| Inlet Pressure, psia | | 16 | 28 | 54 | 106 |
| Outlet Pressure, psia | | 106 | 54 | 208 | 208 |
| Number of Impellers | | 3 | 1 | 2 | 2 |
| Inlet Flow | Impeller 1 | 0.077 | 0.110 | 0.098 | 0.115 |
| Coefficient, $\phi$ | Impeller 2 | 0.051 | — | 0.066 | 0.085 |
| | Impeller 3 | 0.044 | — | — | — |
| Impeller Tip | Impeller 1 | 1.25 | 1.09 | 1.20 | 0.83 |
| Speed, | Impeller 2 | 1.11 | — | 1.08 | 0.82 |
| Mach No. | Impeller 3 | 0.93 | — | — | — |
| Power, HP | | 14,170 | 8,928 | 39,798 | 15,018 |

The inlet flow coefficient, $\phi$, is defined as $$\phi=700Q/Nd^3$$

where Q is the impeller inlet volumetric flow rate in actual $ft^3$/min, N is the rotational speed in revolutions per minute, and d is the impeller diameter in inches.

EXAMPLE 2

Example 1 was repeated using the prior art compressor arrangement of FIG. 2 and the results are given in Table 3.

TABLE 3

Compressor Parameters for Example 2 (Refer to FIG. 2)

| | | Stage 23 | Stage 29 | Stage 27 | Stage 33 |
|---|---|---|---|---|---|
| Suction Volume, $ft^3$/min | | 76,950 | 86,680 | 74,996 | 50,510 |
| Inlet Pressure, psia | | 16 | 28 | 54 | 106 |
| Outlet Pressure, psia | | 54 | 106 | 208 | 208 |
| Number of Impellers | | 2 | 2 | 2 | 1 |
| Inlet Flow | Impeller 1 | 0.090 | 0.096 | 0.075 | 0.063 |
| Coefficient, $\phi$ | Impeller 2 | 0.080 | 0.062 | 0.050 | — |
| Tip Speed, | Impeller 1 | 1.19 | 1.19 | 1.20 | 1.11 |
| Mach No. | Impeller 2 | 0.97 | 1.09 | 1.09 | — |
| Power, HP | | 8,707 | 18,728 | 30,888 | 19,561 |

The split compressor arrangement of the present invention provides a greater turndown range and a greater flow capacity in some stages of the compressors compared to the prior art system of FIG. 2. The hydraulic head or pressure rise across the individual multiple impellers in the low pressure stage (i.e., stage 23 of FIG. 2 and stage 41 of FIGS. 3 and 4) of the split compressor arrangement may be adjusted to achieve essentially the same tip speeds for all the impellers. In the high-intermediate pressure stage (stage 51 of FIGS. 3 and 4), the flow coefficients and tip speeds are nearly the same as those in the prior art system of FIG. 2 (stage 27), and both would provide essentially the same turndown range and flow capacity.

The split compressor arrangement of the present invention provides a slightly higher turndown range and flow capacity in the low-intermediate pressure stage (stage 47 of FIGS. 3 and 4) than the prior art system (stage 29, FIG. 2) and a significantly higher turndown range and flow capacity in the high pressure stage (stage 45, FIGS. 3 and 4) than the prior art system (stage 33, FIG. 2) due to the lower tip speeds of the impellers. A second impeller could be added to stage 33 of the prior art arrangement to reduce the impeller tip speeds, but this would increase the flow coefficient of the first impeller to near the maximum allowable value and severely limit the flow capacity of that stage.

Because the split compressor system for the production of liquefied natural gas (LNG) for the present invention in Example 1 has a greater turndown capability than the prior art system of Example 2, the system of Example 1 typically will result in a lower specific power per ton of LNG product than the system of Example 2 when lower LNG production rates are required by the plant operators.

What is claimed is:

1. A compressor system comprising (a) a first compressor having a first stage and a second stage wherein the first stage of the first compressor is adapted to compress a first gas stream and the second stage of the first compressor is adapted to compress a combination of a fourth gas stream and an intermediate compressed gas from the first stage of the first compressor; and (b) a second compressor having a first stage and a second stage wherein the first stage of the second compressor is adapted to compress a second gas stream and the second stage of the second compressor is adapted to compress a combination of a third gas and stream an intermediate compressed gas from the first stage of the second compressor;

wherein the first gas stream is received by the first compressor at a first pressure, the second gas is received by the second compressor at a second pressure higher than the first pressure, the third gas is received by the second compressor at a third pressure higher than the second pressure, and the fourth gas is received by the first compressor at a fourth pressure higher than the third pressure.

2. The system of claim 1 which further comprises piping means to combine the discharge from the second stage of the first compressor and the discharge from the second stage of the second compressor to provide a combined compressed gas.

3. A method for gas compression comprising (a) compressing a first gas stream in a first stage of a first compressor and compressing in a second stage of the first compressor a combination of a fourth gas stream and an intermediate compressed gas from the first stage of the first compressor, and withdrawing a first compressed gas stream from the second stage of the first compressor;

(b) compressing a second gas stream in a first stage of a second compressor and compressing in a second stage of the second compressor a combination of a third gas stream and an intermediate compressed gas from the first stage of the second compressor, and withdrawing a second compressed gas stream from the second stage of the second compressor; and (c) combining the first compressed gas stream and the second compressed gas stream to provide a final compressed gas stream;

wherein the first gas stream is at received by the first compressor a first pressure, the second gas is received by the second compressor at a second pressure higher than the first pressure, the third stream gas is received by the second compressor at a third pressure higher than the second pressure, the fourth gas stream is received by the first compressor at a fourth pressure higher than the third pressure, and the final compressed gas stream is at a final pressure higher than the fourth pressure.

4. The method of claim 3 wherein any of the first, second, third, and fourth gas streams is a refrigerant gas provided from a refrigeration system and the final compressed gas stream is a compressed refrigerant gas provided to the refrigeration system.

5. A refrigeration system for providing refrigeration at multiple temperature levels comprising (a) a compressor system for providing a compressed refrigerant gas, wherein the compressor system includes (1) a first compressor having a first stage and a second stage wherein the first stage of the first compressor is adapted to compress a first refrigerant gas stream and the second stage of the first compressor is adapted to compress a combination of a fourth refrigerant gas stream and an intermediate compressed refrigerant gas from the first stage of the first compressor; and (2) a second compressor having a first stage and a second stage wherein the first stage of the second compressor is adapted to compress a second refrigerant gas stream and the second stage of the second compressor is adapted to compress a combination of a third refrigerant gas stream and an intermediate compressed refrigerant gas from the first stage of the second compressor; and (3) piping means to combine the discharge from the second stage of the first compressor and the discharge from the second stage of the second compressor to provide the compressed refrigerant gas;

wherein the first refrigerant gas stream is received by the first compressor at a first pressure, the second refrigerant gas stream is at a received by the second compressor second pressure higher than the first pressure, the third refrigerant gas stream is at received by the second compressor a third pressure higher than the second pressure, and the fourth refrigerant gas received by the first compressor is at a fourth pressure higher than the third pressure;

(b) a compressor aftercooler to cool and condense the compressed refrigerant gas, thereby providing a condensed refrigerant stream; and (c) a refrigeration apparatus adapted to provide refrigeration in four temperature ranges, wherein the refrigerant apparatus comprises (1) first pressure reduction means to reduce the pressure of the condensed refrigerant stream to the fourth pressure, thereby providing a reduced-pressure refrigerant liquid at the fourth pressure;

(2) piping means to divide the reduced-pressure refrigerant liquid at the fourth pressure into a first refrigerant portion and a second refrigerant portion at the fourth pressure;

(3) heat exchange means to vaporize the first refrigerant portion of (2) at the fourth pressure, thereby providing refrigeration in a first temperature range and providing the fourth refrigerant gas stream;

(4) second pressure reduction means to reduce the pressure of the second refrigerant portion of (2) from the fourth pressure to the third pressure, thereby providing a reduced-pressure refrigerant at the third pressure;

(5) piping means to divide the reduced-pressure refrigerant liquid at the third pressure into a first refrigerant portion and a second refrigerant portion at the third pressure;

(6) heat exchange means to vaporize the first refrigerant portion of (5) at the third pressure, thereby providing refrigeration in a second temperature range and providing the third refrigerant gas stream;

(7) third pressure reduction means to reduce the pressure of the second refrigerant portion of (5) from the third pressure to the second pressure, thereby providing a reduced-pressure refrigerant at the second pressure;

(8) piping means to divide the reduced-pressure refrigerant liquid at the second pressure into a first refrigerant portion and a second refrigerant portion at the second pressure;

(9) heat exchange means to vaporize the first refrigerant portion of (8) at the second pressure, thereby providing refrigeration in a third temperature range and providing the second refrigerant gas stream;

(10) fourth pressure reduction means to reduce the pressure of the second refrigerant portion of (8) from the second pressure to the first pressure, thereby providing a reduced-pressure refrigerant at the first pressure; and

(11) heat exchange means to vaporize the reduced-pressure refrigerant at the first pressure, thereby providing refrigeration in a fourth temperature range and providing the first refrigerant gas stream.

6. The refrigeration system of claim 5 wherein the refrigeration apparatus is adapted to cool another compressed refrigerant gas.

7. The refrigeration system of claim 5 wherein the refrigeration apparatus is adapted to precool natural gas prior to liquefaction.

8. A refrigeration process comprising (a) providing a compressor system including (1) a first compressor having a first stage and a second stage wherein the first stage of the first compressor is adapted to compress a first refrigerant gas and the second stage of the first compressor is adapted to compress a combination of a fourth refrigerant gas and an intermediate compressed refrigerant gas from the first stage of the first compressor; and (2) a second compressor having a first stage and a second stage wherein the first stage of the second compressor is adapted to compress a second refrigerant gas and the second stage of the second compressor is adapted to compress a combination of a third refrigerant gas and an intermediate compressed refrigerant gas from the first stage of the second compressor; and (3) piping means to combine the discharge from the second stage of the first compressor and the discharge from the second stage of the second compressor to provide a compressed refrigerant gas;

wherein the first refrigerant gas is received by the first compressor at a first pressure, the second refrigerant gas is received by the second compressor at a second pressure higher than the first pressure, the third refrigerant gas is received by the second compressor at a third pressure higher than the second pressure, and the fourth refrigerant gas is received by the first compressor at a fourth pressure higher than the third pressure;

(b) compressing a refrigerant gas in the compressor system of (a) to provide a compressed refrigerant gas;

(c) cooling and condensing the compressed refrigerant gas, thereby providing a condensed refrigerant stream; and (d) providing refrigeration in four temperature ranges by (1) reducing the pressure of the condensed refrigerant stream to the fourth pressure, thereby providing a reduced-pressure refrigerant liquid at the fourth pressure;

(2) dividing the reduced-pressure refrigerant liquid at the fourth pressure into a first refrigerant portion and a second refrigerant portion at the fourth pressure;

(3) vaporizing the first refrigerant portion of (2) at the fourth pressure, thereby providing refrigeration in a first temperature range and providing the fourth refrigerant gas;

(4) reducing the pressure of the second refrigerant portion of (2) from the fourth pressure to the third pressure, thereby providing a reduced-pressure refrigerant at the third pressure;

(5) dividing the reduced-pressure refrigerant liquid at the third pressure into a first refrigerant portion and a second refrigerant portion at the third pressure;

(6) vaporizing the first refrigerant portion of (5) at the third pressure, thereby providing refrigeration in a second temperature range and providing the third refrigerant gas;

(7) reducing the pressure of the second refrigerant portion of (5) from the third pressure to the second pressure, thereby providing a reduced-pressure refrigerant at the second pressure;

(8) dividing the reduced-pressure refrigerant liquid at the second pressure into a first refrigerant portion and a second refrigerant portion at the second pressure;

(9) vaporizing the first refrigerant portion of (8) at the second pressure, thereby providing refrigeration in a third temperature range and providing the second refrigerant gas;

(10) reducing the pressure of the second refrigerant portion of (8) from the second pressure to the first pressure, thereby providing a reduced-pressure refrigerant at the first pressure; and

(11) vaporizing the reduced-pressure refrigerant at the first pressure, thereby providing refrigeration in a fourth temperature range and providing the first refrigerant gas.

9. The process of claim 8 which further comprises cooling an additional compressed refrigerant gas by the refrigeration provided in at least one of the first, second, third, and fourth temperature ranges.

10. The process of claim 8 wherein the additional compressed refrigerant gas is a mixed refrigerant gas containing two or more components selected from the group consisting of nitrogen and hydrocarbons having from one to five carbon atoms.

11. The process of claim 8 which further comprises precooling natural gas prior to liquefaction by the refrigeration provided in at least one of the first, second, third, and fourth temperature ranges.

12. The process of claim 8 wherein the compressed refrigerant gas is a single component selected from hydrocarbons having from two to four carbon atoms.

13. The process of claim 8 wherein the compressed refrigerant gas comprises two or more components selected from the group consisting of nitrogen and hydrocarbons having from one to five carbon atoms.

* * * * *

UNITED STATES PATENT AND TRADEMARK OFFICE

CERTIFICATE OF CORRECTION

PATENT NO. : 6,962,060 B2 
DATED : November 8, 2005
INVENTOR(S) : Joseph Michael Petrowski and Mark Julian Roberts It is certified that error appears in the above-identified patent and that said Letters Patent is hereby corrected as shown below:

Column 12,
Line 8, add -- stream -- after "of a third gas".
Line 30, add -- stream -- after "the second gas".
Line 32, add -- stream -- after "the third gas".
Line 34, add -- stream -- after "fourth gas".
Line 59, delete "at" after "wherein the first gas stream is".
Line 60, add -- at -- after "compressor:", and add -- stream -- after "the second gas".
Line 62, delete "stream" after "pressure, the third" and add -- stream -- after "gas".

Signed and Sealed this

Twenty-eighth Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,962,060 B2 
DATED : November 8, 2005
INVENTOR(S) : Joseph Michael Petrowski and Mark Julian Roberts It is certified that error appears in the above-identified patent and that said Letters Patent is hereby corrected as shown below:

Column 12,
Line 8, add -- stream -- after "of a third gas".
Line 30, add -- stream -- after "the second gas".
Line 32, add -- stream -- after "the third gas".
Line 34, add -- stream -- after "fourth gas".
Line 59, delete "at" after "wherein the first gas stream is".
Line 60, add -- at -- after "compressor:", and add -- stream -- after "the second gas".
Line 62, delete "stream" after "pressure, the third" and add -- stream -- after "gas".

Column 13,
Line 33, delete "at a" after "gas stream".
Line 34, add -- at a -- after "compressor".
Line 35, delete "at" after "refrigerant gas stream is".
Line 36, add -- at -- after "second compressor".
Line 37, add -- stream is -- after "refrigerant gas".
Line 38, delete "is" after "by the first compressor".

Column 14,
Line 40, add -- stream -- after "a first refrigerant gas".
Line 42, add -- stream -- after "fourth refrigerant gas".
Line 48, add -- stream -- after "refrigerant gas".
Line 50, add -- stream -- after "third refrigerant gas".
Line 53, add -- stream -- after "wherein the first refrigerant gas…".
Line 55, add -- stream -- after "gas".
Line 57, add -- stream -- after "errant gas".
Line 59, add -- stream -- after "fourth refrigerant gas….".

Column 15,
Lines 15 and 26, add -- stream -- after "refrigerant gas.".

UNITED STATES PATENT AND TRADEMARK OFFICE

CERTIFICATE OF CORRECTION

PATENT NO. : 6,962,060 B2 
DATED : November 8, 2005
INVENTOR(S) : Joseph Michael Petrowski and Mark Julian Roberts It is certified that error appears in the above-identified patent and that said Letters Patent is hereby corrected as shown below:

Column 16,
Line 4, add -- stream -- after "refrigerant gas".
Line 12, add -- stream -- after "refrigerant gas.".
Line 17, change "8 to 9." to -- the process of Claim 9…. --.

This certificate supersedes Certificate of Correction issued February 28, 2006.

Signed and Sealed this

Twenty-third Day of May, 2006

JON W. DUDAS
*Director of the United States Patent and Trademark Office*